US010836059B2

(12) United States Patent
Efthimiadis et al.

(10) Patent No.: US 10,836,059 B2
(45) Date of Patent: Nov. 17, 2020

(54) SHAVING COMPONENT, SHAVING CARTRIDGE, AND METHOD OF MANUFACTURE

(71) Applicant: BIC-VIOLEX SA, Anixi (GR)

(72) Inventors: Dimitrios Efthimiadis, Athens (GR); Panagiotis Kopelas, Dafni-Athens (GR)

(73) Assignee: BIC-VIOLEX SA, Anixi (GR)

( * ) Notice: Subject to any disclaimer, the term of this patent is extended or adjusted under 35 U.S.C. 154(b) by 0 days.

(21) Appl. No.: 16/302,133

(22) PCT Filed: Jun. 16, 2017

(86) PCT No.: PCT/EP2017/064848
§ 371 (c)(1),
(2) Date: Nov. 16, 2018

(87) PCT Pub. No.: WO2018/007134
PCT Pub. Date: Jan. 11, 2018

(65) Prior Publication Data

US 2019/0283265 A1 Sep. 19, 2019

Related U.S. Application Data

(60) Provisional application No. 62/358,667, filed on Jul. 6, 2016.

(51) Int. Cl.
*B26B 21/22* (2006.01)
*B26B 21/40* (2006.01)
*B26B 21/56* (2006.01)

(52) U.S. Cl.
CPC ..... *B26B 21/227* (2013.01); *B26B 21/4012* (2013.01); *B26B 21/4031* (2013.01);
(Continued)

(58) Field of Classification Search
CPC ..... B26B 21/00; B26B 21/22; B26B 21/222; B26B 21/225; B26B 21/227; B26B 21/40; B26B 21/4012; B26B 21/4031
(Continued)

(56) References Cited

U.S. PATENT DOCUMENTS 2,424,260 A * 7/1947 Testi ..... B26B 21/18 30/65
6,493,950 B1 * 12/2002 Kludjian ..... B26B 21/22 30/298

(Continued)

FOREIGN PATENT DOCUMENTS

WO 2016/102024 A1 6/2016

OTHER PUBLICATIONS

International Search Report for PCT/EP2017/064848 dated Oct. 4, 2017.

*Primary Examiner* — Andrea L Wellington
*Assistant Examiner* — Richard D Crosby, Jr.
(74) *Attorney, Agent, or Firm* — Polsinelli PC

(57) ABSTRACT

A shaving component for a shaving cartridge including at least one cutting member and at least one flexible strip onto which the cutting member is assembled. The flexible strip is able to assume different configurations such as a planar, convex and/or convex configuration while retaining the cutting member in a desired position. The shaving component is configured to be fastened to the shaving cartridge such as a hinged shaving cartridge.

15 Claims, 6 Drawing Sheets

(52) U.S. Cl.
CPC ..... *B26B 21/4068* (2013.01); *B26B 21/56* (2013.01); *B26B 21/565* (2013.01)

(58) Field of Classification Search
USPC ..... 30/47–51
See application file for complete search history.

(56) References Cited

U.S. PATENT DOCUMENTS

2003/0204954 A1* 11/2003 Wain ..... B26B 21/56 30/49
2004/0020053 A1* 2/2004 Wain ..... B26B 21/227 30/50
2007/0209206 A1* 9/2007 Van Eibergen Santhagens ..... B26B 21/40 30/50
2009/0193659 A1* 8/2009 Park ..... B26B 21/521 30/50
2010/0218381 A1* 9/2010 Follo ..... B26B 21/44 30/77
2011/0308089 A1 12/2011 Bridges
2012/0030948 A1* 2/2012 Walker, Jr. ..... B26B 21/4018 30/50
2012/0324737 A1* 12/2012 Howell ..... B26B 21/4031 30/50
2014/0026424 A1* 1/2014 Oglesby ..... B26B 21/4031 30/50
2014/0259675 A1* 9/2014 Tucker ..... B26B 21/4012 30/41
2014/0259677 A1* 9/2014 Coresh ..... B26B 21/4031 30/50
2014/0373362 A1* 12/2014 Bozikis ..... B26B 21/4031 30/50
2015/0013169 A1* 1/2015 Warrick ..... B26B 21/4031 30/50
2015/0082683 A1 3/2015 Georgakis et al.
2015/0090085 A1* 4/2015 Griffin ..... B26B 21/4012 83/13
2015/0101195 A1* 4/2015 Long ..... B26B 21/443 30/41.5
2016/0089800 A1* 3/2016 Coresh ..... B26B 21/38 30/45
2017/0266825 A1* 9/2017 Bozikis ..... B26B 21/4037
2017/0282385 A1* 10/2017 Bozikis ..... B26B 21/4043
2017/0341247 A1* 11/2017 Zafiropoulos ..... B26B 21/565
2019/0224874 A1* 7/2019 Blatter ..... B26B 21/225

* cited by examiner

Shaving direction

SHAVING COMPONENT, SHAVING CARTRIDGE, AND METHOD OF MANUFACTURE

CROSS REFERENCE TO RELATED APPLICATION

This application is a National Stage application of International Application No. PCT/EP2017/064848, filed on Jun. 16, 2017, now published as WO2018/007134 A1, which claims priority to U.S. Provisional Application No. 62/358,667, the entire contents of each is incorporated herein by reference.

FIELD

The following disclosure relates to shaving components, to shaving cartridges and to methods of manufacturing shaving components. More particularly, the disclosure relates to a cartridge having a flexible strip that allows the cartridge to assume different configurations during shaving.

BACKGROUND

Many conventional shaving cartridge heads are equipped with a plurality of movable blades. These heads are rigid, but operable to permit a small degree of movement of the blades relative to the heads so that the blades can somewhat follow a skin contour to a small degree via an up or down vertical movement of the blades relative to the heads.

The plurality of movable blades is retained within a housing by retaining members, or by an ultrasonic welded cap, or by any other kind of retainers. A conventional retaining member is usually a metal clip. Metal clips on the housing retain the blades in the slots and determine the positions of the cutting edges of the blades in the rest position.

Conventional heads, however, suffer from various limitations. For instance, the blades are only allowed to follow the skin contour towards a shaving motion direction, as illustrated via FIG. 1A. Further, the blades are secured to the heads in a manner whereby a blade-to-skin angle is not constant, as illustrated via FIG. 2A and FIG. 2B. These limitations are not advantageous in that they prevent a user from obtaining a close shave, i.e., an ideal shave whereby unwanted hair is severed by the blades as close to the skin as possible without cutting the skin, resulting in nicks and cuts to the skin of the user.

SUMMARY

According to aspects of the disclosure, a shaving component may include a flexible strip that may be able to assume a plurality of configurations while retaining a cutting member in a secured position with respect to the flexible strip. Other aspects may include providing a shaving cartridge with the shaving component. Further aspects may include, a method of manufacturing the shaving component.

More specifically, the disclosure may involve a shaving component for a shaving cartridge that may include at least one cutting member and at least one flexible strip. The at least one cutting member may have a cutting edge and may be assembled onto the flexible strip which may be configured to assume different configurations, while the cutting members may be retained in a secured position with respect to the flexible strip. By "secured position" it is meant that the flexible strip keeps the cutting member placed in a proper sequence, substantially parallel to each other. The different configurations may be convex, concave and/or a planar.

The disclosure may further involve a shaving cartridge that may include a housing having a top and a bottom portion, and a shaving window arranged at the top portion of the housing configured to receive the shaving component such that the cutting members are exposed via the top portion of the housing. The housing may include a plurality of side portions on either side of the housing. The plurality of side portions of the shaving cartridge may be rotatably secured together via connectors. Such shaving cartridge may also be called an "articulated shaving cartridge". For example, the connector may be a hinge. Also, other types connectors may be used as well. Thus, the shaving cartridge may be called a "hinged shaving cartridge". The housing may assume different configurations according to the skin contours of the user. The shaving component may be placed within the shaving window together with the connectors, and may allow for the relative pivoting of the shaving cartridge while keeping the cutting members secured within the shaving window. Each of the connectors may be operable to permit the side portions of the shaving cartridge to pivot relative to each other. Upon application of forces applied by the skin during the shaving process on the top portion (also called "top surface") of the housing and/or one or more of the cutting members, the shaving cartridge may be able to assume a plurality of configurations. The plurality of configurations may include a convex, concave and/or planar configuration. More specifically, the housing may assume the convex configuration when the shaving cartridge may encounter a recess of the skin (a concave skin area) of the user. In other words, the forces acting from the concave skin area may be applied on the top portion of the housing causing the shaving cartridge to assume the convex configuration. The concave configuration of the shaving cartridge may be assumed when the shaving cartridge may encounter a protrusion of the skin (a convex skin area) of the user. In other words, the forces acting from the convex skin area may be applied on the top surface of the housing causing the shaving cartridge to assume the concave configuration. The planar configuration of the shaving cartridge may be assumed when forces acting from a flat skin area (a planar skin area, without protrusion and/or recesses), may be applied on the top surface of the housing.

In some examples, one may also use one or more of the features defined in the dependent claims.

The foregoing is intended to be illustrative and is not meant in a limiting sense. Many features of the examples may be employed with or without reference to other features of any of the examples. Additional aspects, advantages, and/or utilities of the present disclosure will be set forth in part in the description that follows and, in part, will be apparent from the description, or may be learned by practice of the present disclosure.

BRIEF DESCRIPTION OF THE DRAWINGS

The foregoing summary, as well as the following detailed description, will be better understood when read in conjunction with the appended drawings. For the purpose of illustration, there is shown in the drawings certain examples of the present disclosure. It should be understood, however, that the present disclosure is not limited to the precise examples and features shown. The accompanying drawings, which are incorporated in and constitute a part of this specification, illustrate an implementation of apparatuses consistent with the present disclosure and, together with the description, serve to explain advantages and principles consistent with the present disclosure.

DETAILED DESCRIPTION

While the embodiments have been described in detail in the foregoing description, the same is to be considered as illustrative and not restrictive in character, it being understood that only some embodiments have been shown and described and that all changes and modifications that come within the spirit of the embodiments are desired to be protected. While said particular embodiments of the present disclosure have been described, it would be obvious to those skilled in the art that various other changes and modifications may be made without departing from the spirit and scope of the disclosure. It is therefore intended to cover in the appended claims all such changes and modifications are within the scope of the disclosure.

I. General Architecture of the Shaving Component

Figure 1:
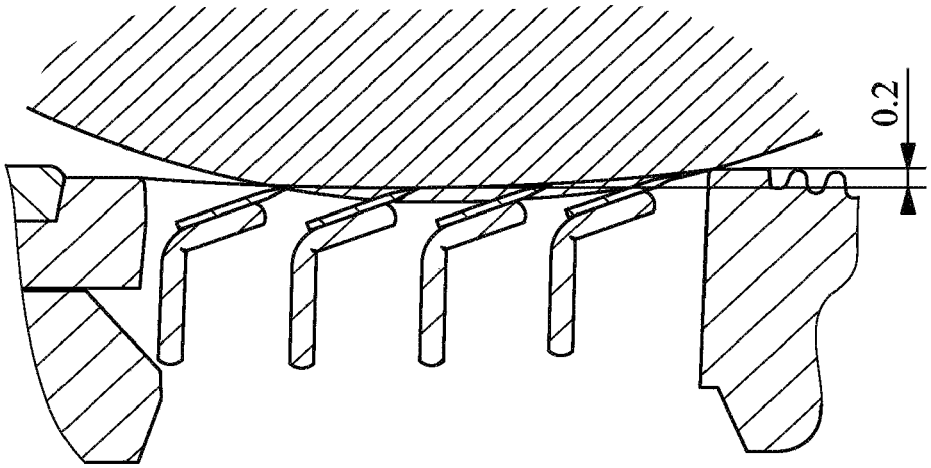
FIG. 1 (Prior Art)
FIG. 1 is a partial cross-sectional view of the conventional head with blades only operable to follow a skin contour towards a shaving direction.
Figure 2A:
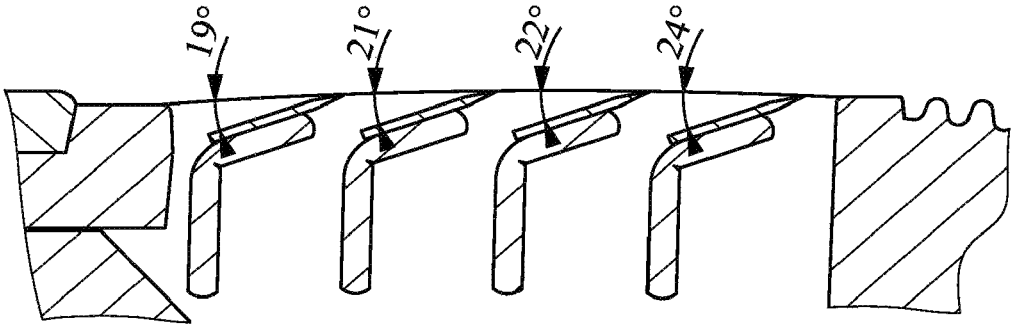
FIG. 2A (Prior Art)
FIG. 2A is a partial cross-sectional view of the conventional head with blades having different blade-to-skin angles that are not constant due to a concave contour of a shaving surface.
Figure 2B:
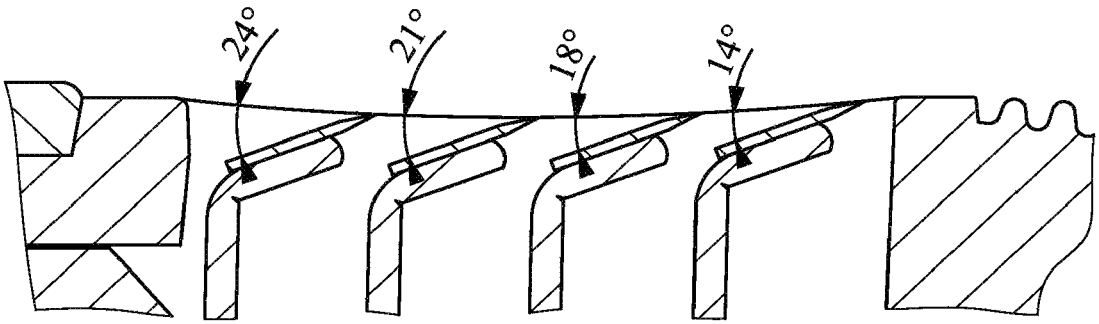
FIG. 2B (Prior Art)
FIG. 2B is a partial cross-sectional view of the conventional head with blades having different blade-to-skin angles that are not constant due to a convex contour of a shaving surface.
Figure 3:
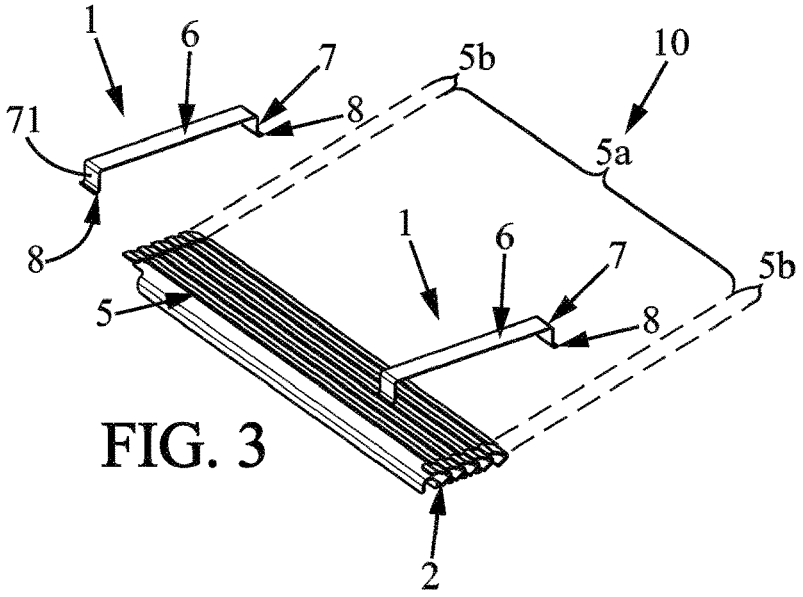
FIG. 3 is an exploded perspective view of the shaving component according to an aspect of the disclosure.

According to aspects, as shown in FIG. 3, a shaving component 10 may include at least one cutting member 2. For example, the shaving component 10 may include five parallel cutting members 2. According to other aspects, the shaving component 10 may include more or less than five cutting members 2. For example, the shaving component may comprise at least one cutting member. The cutting members may be similar to one another. The at least one cutting member 2 may be at least one blade. The at least one cutting member 2 may include a cutting edge 5 extending along a longitudinal axis X-X. The cutting member 2 may be profiled along the longitudinal axis X-X. This may be true, in particular, in a central portion of the cutting member 2. Lateral sides of the cutting member 2, opposed along the longitudinal axis X-X, may exhibit a specific functional geometry. For example, the cutting member 2 may be L-shaped, as shown in FIGS. 2A and 2B. The cutting member 2 may thus include a cutting-edge portion, a bent portion and a base portion. The bent portion may be intermediate to the cutting-edge portion and the base portion. There may typically be an angle of about 105° to 120° between the cutting-edge portion and the base portion. The cutting member 2 may have different shapes, for example, a "reverse L" (shown on FIG. 7A), and/or a "question mark" shape (shown on FIG. 8A). According to further aspects, other shapes may be possible.

Figure 7A:
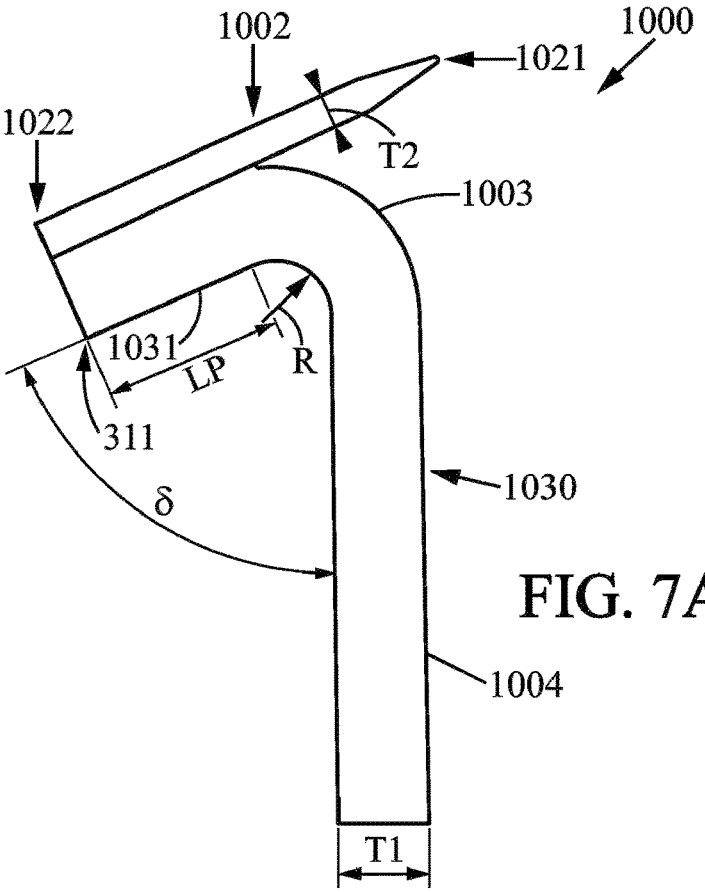
FIG. 7A is a cross-sectional view of a cutting member according to an aspect of the disclosure.
Figure 7B:
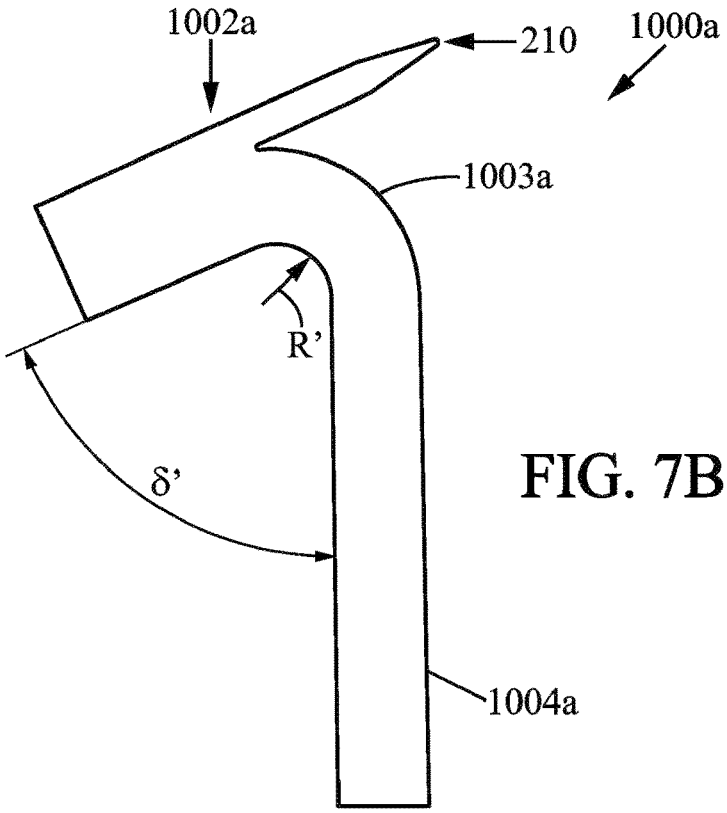
FIG. 7B is a cross-sectional view of a cutting member according to an aspect of the disclosure.

According to some aspects, as detailed in FIGS. 7A and 7B, the cutting member 1000 may have the "reverse L" shape. By "reverse", it is meant that, along this orientation, the "L" may be rotated by 180°. The cutting member 1000 may include a flat cutting portion 1002, a bent portion 1003 and a base portion 1004, wherein the cutting member 1000 may be formed such that at least the bent portion 1003 and the base portion 1004 may be made out of one single piece of material.

The flat cutting portion 1002 may extend in the longitudinal direction, along the longitudinal axis X-X. The flat cutting portion 1002 may include a front cutting-edge portion 1021 and a rear end 1022 opposite to the front cutting-edge portion 1021. The flat cutting portion 1002 may define a cutting portion plane. The flat cutting portion 1002 may be supported on a support portion 1030. The support portion 1030 may include the base portion 1004, the bent portion 1003, and a platform portion 1031 to which the flat cutting portion 1002 may be mounted. The flat cutting portions 1002 may be attached to the support portion 1030 by welding techniques or any other techniques such as gluing or adhesives. The support portion 1030 may be profiled along the axis X-X. For example, the geometry of the support portion 1030 may be substantially similar along the axis X-X (shown in FIG. 6A) The platform portion 1031 may extend between the bent portion 1003 and the rear end 1022 of the flat cutting portion, and may extend towards the bent portion 1003. The platform portion 1031 may be connected to the flat cutting portion 1002. The platform portion 1031 may include a tip portion 311. The platform portion 1031 may be made out of one single piece of material with the bent portion 1003 and the base portion 1004. The base portion 1004 may extend downward from the bent portion 1003. The bent portion 1003 may be intermediate to the platform portion 1031 and the base portion 1004, and may extend between the platform portion 1031 and the base portion 1004. The tip portion 311 may be arranged such that the tip portion 311 may be adjacent to the rear end 1022 of the flat cutting portion. The support portion 1030 may be made out of various materials, such as metal material(s). The bent portion 1003 may have an inner radius of curvature R, also called "radius of curvature", that may be between 0.1 mm and 0.3 mm. According to some aspects, the radius of curvature R may be between 0.15 mm and 0.25 mm, and according to further aspects about 0.2 mm. The platform portion 1031 may extend at an angle δ of 45° to 90° relative to the base portion 1033. According to some aspects, the platform portion 1031 may extend at an angle δ of 50° to 80°, and according to further aspects at an angle δ of about 70°. The platform portion 1031 of the support portion may be between 0.2 mm and 1.5 mm in length LP from the tip portion 311 and the bent portion 1003. However, according to some aspects, the length LP of the platform portion 1021 may be about 0.4 mm to 1.0 mm, and according to further aspects about 0.5 mm (shown in FIG. 7A). A thickness T2 (illustrated in FIG. 7A) of the flat cutting portion 1002 of the cutting member may be between 0.04 mm and 0.11 mm. According to some aspects, the thickness T2 may be about 0.1 mm. A thickness T1 (illustrated in FIG. 7A) of the support portion 1030 may be between 0.07 mm and 0.18 mm. According to some aspects, the thickness T1 may be between 0.10 mm and 0.15 mm and according to further aspects, about 0.12 mm.

According to other aspects, the cutting member 1000*a* may include the flat cutting portion 1002*a*, the bent portion 1003*a*, and the base portion 1004*a*. The flat cutting portion 1002*a* may extend in the longitudinal direction, along the longitudinal axis X-X (axis X-X shown in FIG. 6A). The flat cutting portion 1002*a*, may include the front cutting edge portion 210, where the flat cutting portion 1002*a* may define the cutting portion plane. The flat cutting portion 1002*a* may be made out of one single piece of material with the bent portion 1003*a* and the base portion 1004*a*. The base portion 1004*a* may extend downward from the bent portion 1003*a*. The bent portion 1003*a* may be intermediate to the flat cutting portion 1002*a* and the base portion 1003*a*, and may extend between the flat cutting portion 1002*a* and the base portion 1003*a*. The bent portion 1003*a* may be adjacent to the front cutting edge portion 210. The bent portion 1003*a* may have the inner radius of curvature R', also called "radius of curvature", that may be between 0.1 mm and 0.3 mm. According to some aspects, the radius of curvature R may be between 0.15 mm and 0.25 mm, and according to further aspects, about 0.2 mm. The flat cutting portion 1002*a* may extend at the angle δ' of 45° to 90° relative to the base portion 1004*a*. However, according to some aspects, the flat cutting portion 1002 may extend at an angle δ' of 50° to 80°, and according to further aspects at an angle δ' of about 70°.

Figure 8A:
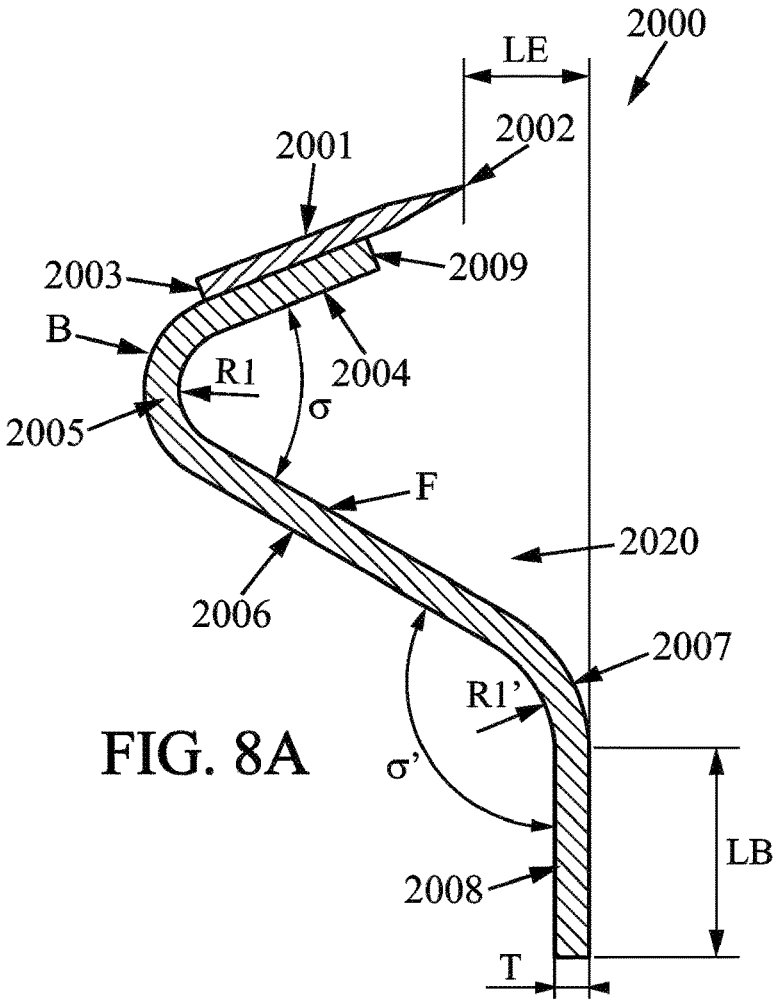
FIG. 8A is a cross-sectional view of a cutting member according to an aspect of the disclosure.
Figure 8B:
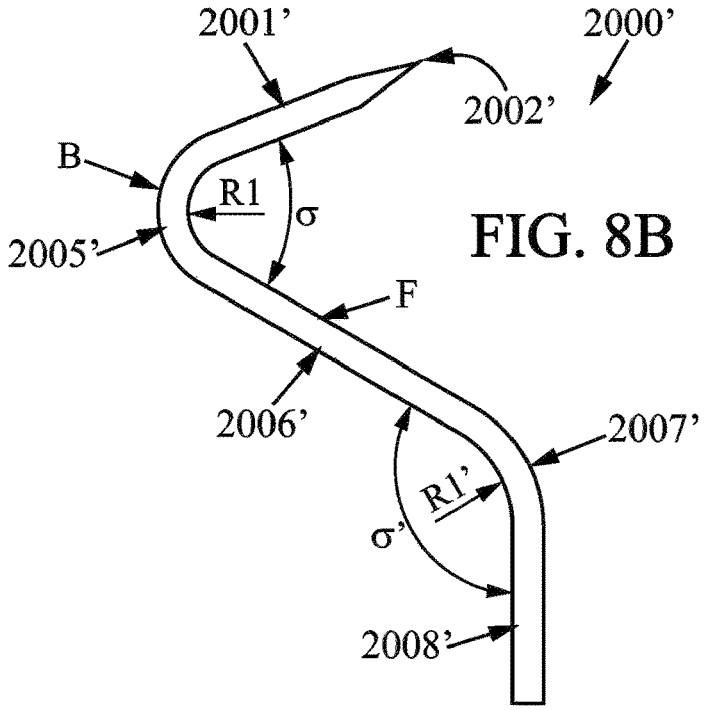
FIG. 8B is a cross-sectional view of a cutting member according to an aspect of the disclosure.

According to other aspects, as detailed in FIGS. 8A and 8B, a cutting member 2000 may have the "question mark" shape. "The cutting member 2000 may include a backside B and a front side F opposing the back-side B.

The cutting member 2000 may include a flat cutting portion 2001 having a cutting-edge portion 2002 and an end portion 2003 opposing the cutting-edge portion 2002. The cutting member 2000 may include a platform portion 2004, a first bent portion 2005, an intermediate portion 2006, a second bent portion 2007, and a base portion 2008. The cutting-edge portion 2002 may be opposite to the first bent portion 2005. The platform portion 2004 may include a front end 2009 adjacent to the cutting-edge portion 2002. The platform portion 2004 may be made out of one single piece of material with the first bent portion 2005, the intermediate portion 2006, the second bent portion 2007 and the base portion 2008. The flat cutting portion 2001 may be mounted on the platform portion 2004. In other words, the platform portion 2004 may be configured to carry or to support the flat cutting portion 2001. The platform portion 2004, the first bent portion 2005, the intermediate portion 2006, the second bent portion 2007 and the base portion 2008, together, may for the support portion 2020. The support portion 2020 may be made out of for example a plastic material, or any other suitable materials may be used. The flat cutting portions 2001 may be attached to the platform portion 2004 by welding techniques or any other techniques such as gluing or adhesives. According to aspects, the flat cutting portion 2001 may be carried by the platform portion 2004. The platform portion 2004 may extend towards the first bent portion 2005. The platform portion 2004 may be connected to the flat cutting portion 2001, and may be configured to support the flat cutting portion 2001. The end portion 2003 of the flat cutting portion may be near/adjacent to the first bent portion 2005. The first bent portion 2005 may be between the platform portion 2004 and the intermediate portion 2006, i.e. the first bent portion 2005 may extend between the platform portion 2004 and the intermediate portion 2006. The first bent portion 2005 may be concave on the front side F of the cutting member, i.e. the first bent portion 2005 may have a concave shape on the front side F. According to some aspects, a concave shape may include a shape that may be curved inward. As viewed from the back-side B of the cutting member, the first bent portion 2005 may be formed in a convex shape. According to some aspects, a convex shape may be the opposite of the concave shape, i.e. a convex shape may be bulged or curved outward. The intermediate portion 2006 may extend between the first bent portion 2005 and the second bent portion 2007. A first angle σ, formed between the flat cutting portion 2001 and the intermediate portion 2006, may be between 45° to 80°. According to some aspects, the first angle σ may be between 50° and 70° and according to further aspects, about 52°. The second bent portion 2007 may be formed between the intermediate portion 2006 and the base portion 2008. The second bent portion 2007 may be intermediate to the base portion 2008 and the intermediate portion 2006. The second bent portion 2007 may be formed in the convex shape on the front side F of the cutting member. On the other hand, on the back-side B of the cutting member, the second bent portion 2007 may assume the concave shape. A second angle σ', formed between the intermediate portion 2006 and the base portion 2008, may be between 100° and 160°. However, according to some aspects, the second angle σ' may be between 120° and 140°, and according to further aspects, about 130°, as shown in FIG. 7A. The base portion 2008 may extend downward from the second bent portion 2007. The base portion 2008 may have a length LB of between 0.6 mm to 1.2 mm. However, according to some aspects, the length LB may be between 0.65 mm to 1.0 mm and according to further aspects about 0.70 mm. A thickness (dimension T) of the single piece of material forming the cutting member 2000 may be between 0.07 mm and 0.18 mm. According to some aspects, the thickness T may be between 0.10 mm and 0.15 mm, and according to further aspects, around 0.12 mm. A dimension LE may be a distance in mm at which the base portion 2008 may exceed over the platform portion 2004. More particularly, LE may be the distance measured from the front end 2009 of the platform portion to the front side F of the base portion along the transverse axis Y-Y. The LE may be between the 0.35 mm and 1.00 mm. According to some aspects, when the flat cutting portion 2001 is not mounted on the platform portion 2004, the distance LE may be between 0.5 mm and 0.9 mm; however, according to further aspects the distance LE may be about 0.75 mm. According to other aspects, when the flat cutting portion 2001 is mounted on the platform portion 2004, the distance LE, may be measured from the cutting-edge portion 2002 of the flat cutting portion to the front side F of the base portion and may be between 0 mm and 0.6 mm. According to some aspects, the distance LE may be between 0.3 mm and 0.5 mm and according to further aspects, about 0.40 mm. The first bent portion 2005 may have a first inner radius of curvature R1, also called "first radius of curvature", that may be between 0.09 mm and 0.27 mm. However, according to some aspects, the first radius of curvature R1 may be between 0.12 mm and 0.24 mm, and according to further aspects, around 0.21 mm. The second bent portion 2007 may have a second inner radius of curvature R1' also called "second radius of curvature", that may be between 0.1 mm and 0.7 mm. According to some aspects, the second radius of curvature R2 may be between 0.3 mm and 0.5 mm, and according to further aspects, around 0.4 mm. As seen in FIGS. 7A and 7B, the shape of the cutting member 2000 may resemble a question mark or "S"-shape.

According to further aspects, the flat cutting portion 2001' may be made out of one single piece of material with the first bent portion 2005', the intermediate portion 2006', the second bent portion 2007' and the base portion 2008' to form the cutting member 2000'. The flat cutting portion 2001' may extend towards the first bent portion 2005' and may be integral with the first bent portion 2005'. The flat cutting portion 2001' may include a cutting-edge portion 2002'. The cutting-edge portion 2002' may be opposite to the first bent portion 2005'. The flat cutting portion 2001' may extend along the longitudinal axis X-X. The cutting member 2000' may also include a back-side B, and a front side F, a first angle σ and a second angle σ', a first radius of curvature R1, second radius of curvature R1', and a dimension LE, as explained in detail, above, in connection with the cutting member 2000.

According to further aspects, the shaving component 10 may include at least one flexible strip 1 as shown in FIG. 3. The flexible strip 1 may be arranged such that the flexible strip 1 may extend along a transverse axis Y-Y. The at least one cutting member 2 may be assembled or mounted onto the flexible strip 1 such that the cutting-edge 5 of the at least one cutting member may be adjacent to the flexible strip 1. The flexible strip 1 may be configured such that the flexible strip 1 may assume a plurality of configurations while retaining the at least one cutting member 2 in a secured position with respect to the flexible strip 1.

The flexible strip 1 may include a body 6 extending along the transverse axis Y-Y between a first end and an opposed second end. The flexible strip 1 may include at least one leg 7 extending from the body 6 along a lateral axis Z-Z transverse to both the longitudinal axis X-X and the transverse axis Y-Y. Further the body 6 of the at least one flexible strip may include a top face 6*a* and a bottom face 6*b* opposite to said top face 6*a*. The bottom face 6*b* may be adjacent to the cutting-edge 5 of the cutting member. The at least one leg 7 may extend from the bottom face of the body 6*b*.

According to some aspects, the flexible strip 1 may include two legs 7, 71, for example, a first leg 7 and a second leg 71. The two legs 7, 71 may be connected together by the body 6 of the flexible strip 1. The body 6 of the flexible strip may extend between the two legs 7, 71. Each leg 7, 71 may include a projection 8. However, according to some aspects, only one leg may have a projection 8. The projection may protrude from the leg 7, 71, along the transverse axis Y-Y, away from the cutting member 2. The leg 7 may allow the shaving component 10, once fastened into a shaving cartridge, to be secured within the shaving cartridge, and may prevent separation of the shaving component 10 from the shaving cartridge. Furthermore, the risk of unintentionally removing the shaving component 10 out of the shaving cartridge may be minimized.

According to aspects, the flexible strip 1, as shown in FIG. 3, may be in a rest position when it is not subject at any external forces. When the flexible strip 1 may be in the rest position, the legs 7, 71 may be parallel to each other, and the flexible strip 1 may assume a planar configuration. The flexible strip 1 may assume a convex configuration or a concave configuration while being subject to external forces. The flexible strip 1 may further assume the convex configuration or the concave configuration, when the external forces may be applied on shaving component 10. The top face 6*a* of the body of the flexible strip may then assume a concave shape (i.e. the top face of the body may be in the concave configuration), while the bottom face 6*b* may assume a convex shape (the bottom face of the body may be in the convex configuration). On the other hand, when the flexible strip 1 may be subject to external forces, the top face 6*a* of the body may assume the convex shape while the bottom face 6*b* may assume the concave shape. According to some aspects, a concave shape may include a shape that may be curved inward. According to some aspects, a convex shape may be the opposite of the concave shape, i.e. the convex shape may be bulged or curved outward.

The flexible strip 1 may be made of a formable material, for example, a thin sheet of suitable metal material. However, other materials may be considered. According to further aspects, the flexible strip 1 may not be metal. As such, the bottom face 6*b* may be coated on metal or any other anti-corrosive material.

Figure 9:
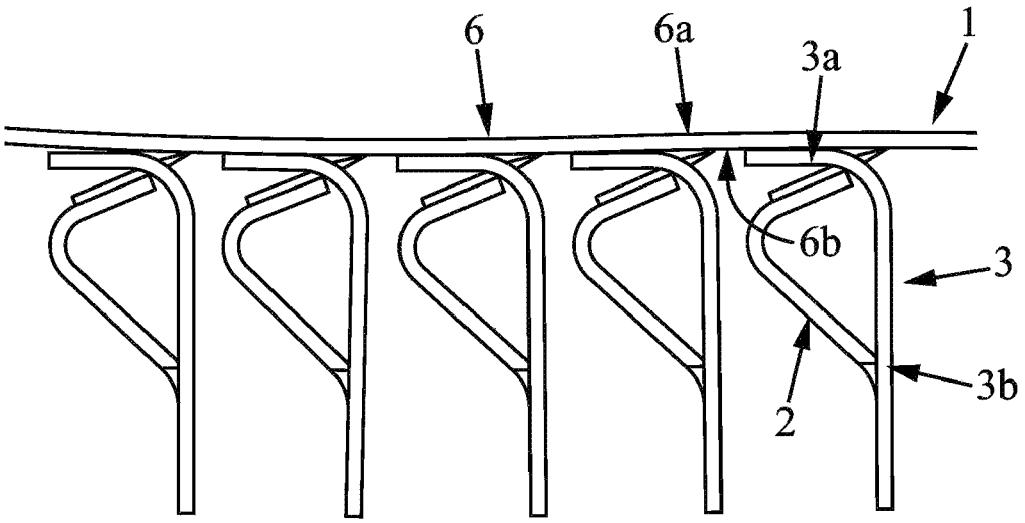
FIG. 9 is a side view of the shaving component according to an aspect of the disclosure.

As discussed above, the at least one cutting member 2 may include a central portion 5*a* and two lateral sides 5*b* as shown in FIG. 3. The at least one lateral side 5*b* of the cutting member may include a connecting mechanism 3 that may be integral with the support portion 2020, 1030 of the cutting member 2. As can be seen in FIG. 9, the connecting mechanism 3 may include a fixation portion 3*a* and a guiding portion 3*b*. The guiding portion 3*b* may be connected to the support portion 2020, 1030 of the cutting member 2 and the fixation portion 3*a* may be attached to the bottom face 6*b* of the body 6 of the flexible strip 1. The fixation portion 3*a* of the connecting mechanism 3, when fixed to the bottom face 6*b* of the body 6, may be located to be in front or adjacent to the cutting-edge 5 of the cutting member 2. The connecting mechanism 3 may be configured to attach or fix the cutting member 2 onto the flexible strip 1.

Figure 4:
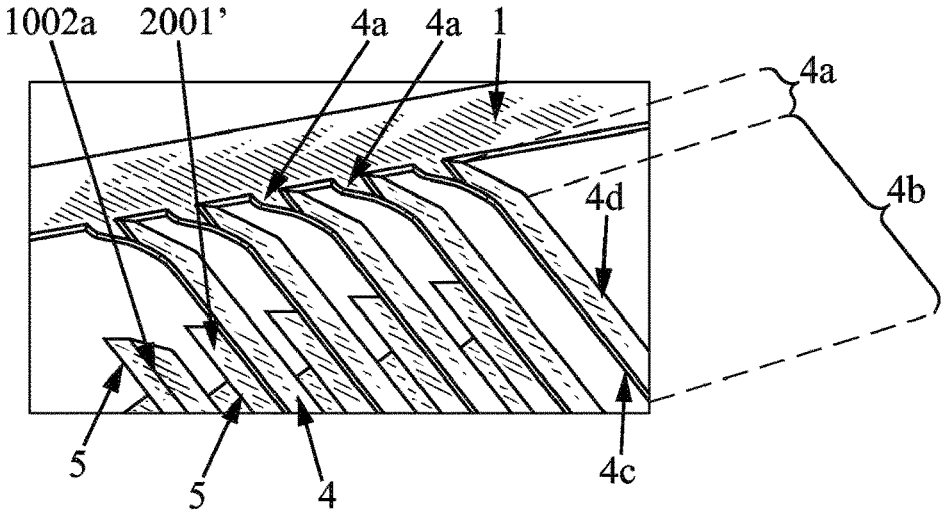
FIG. 4 is enlarged partial perspective view of the shaving component according to another aspect of the disclosure comprising.
Figure 5:
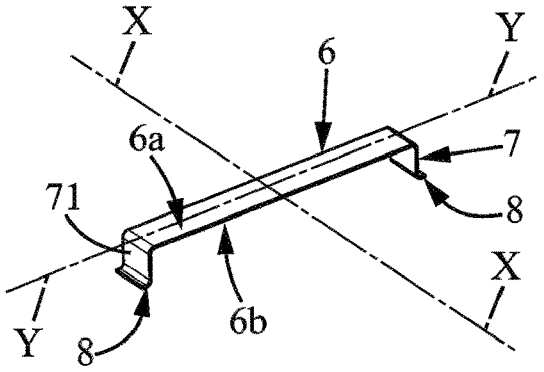
FIG. 5 is a perspective view of a flexible strip of FIG. 3.

According to further aspects, as depicted in FIG. 4, the body 6 of the flexible strip 1 may include at least one strip portion 4. The strip portion 4 may extend from the body 6, along the longitudinal axis X-X and may be made of the same material as the body 6 of the flexible strip 1. The strip portion 4 may further include an end portion 4*a* and a connecting area 4*b*. Further, the strip portion 4 may have a bottom surface 4*c* and a top surface 4*d*. The end portion 4*a* may be intermediate to the connecting area 4*b* and the body 6 of the flexible strip 1, i.e. the end portion 4*a* may be between the connecting area 4*b* and the body 6 of the flexible strip 1. The connecting area 4*b* of the strip portion 4 may be angled with respect to the body 6 of the flexible strip 1. The connecting area 4*b* of the strip portion 4 may be configured to be attached to the cutting member 2. For example, the cutting member 2 may be an integrally formed cutting member 2, as shown in FIGS. 7B and 8B. That is, the flat cutting portion 1002*a* & 2001' may be attached at the bottom surface 4*c* of the strip portion 4 onto the connecting area 4*b*, such that the end portion 4*a* may be located in front and adjacent to the cutting-edge 5 of the cutting member 2. The above explanation of attaching the integrally formed cutting member 2 to the body 6 of the flexible strip 1 may define the cutting angle of the cutting member 2.

According to some aspects, the shaving component 10 may include a plurality of cutting members 2 parallel to each other and assembled onto the flexible strip 1. According to some aspects, the shaving component 10 may include another or second flexible strip 1 onto which the cutting member 2 may assembled. Hence, one flexible strip 1 may be present on each lateral side 5*b* of the cutting member 2. As such, the strip portion 4 may extend from one flexible strip 1 to the other.

II. General Architecture of the Shaving Cartridge

Figure 6A:
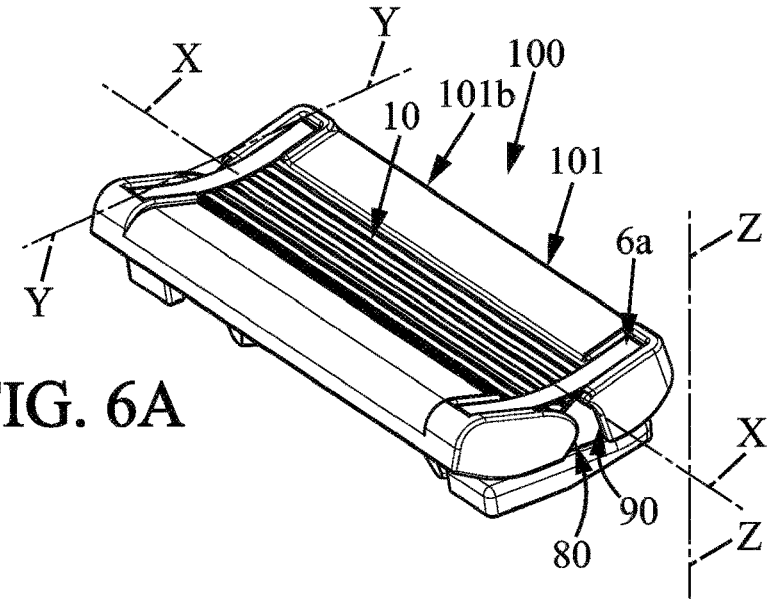
FIG. 6A is a perspective view of the shaving cartridge of FIG. 3 assuming a substantially concave configuration.
Figure 6B:
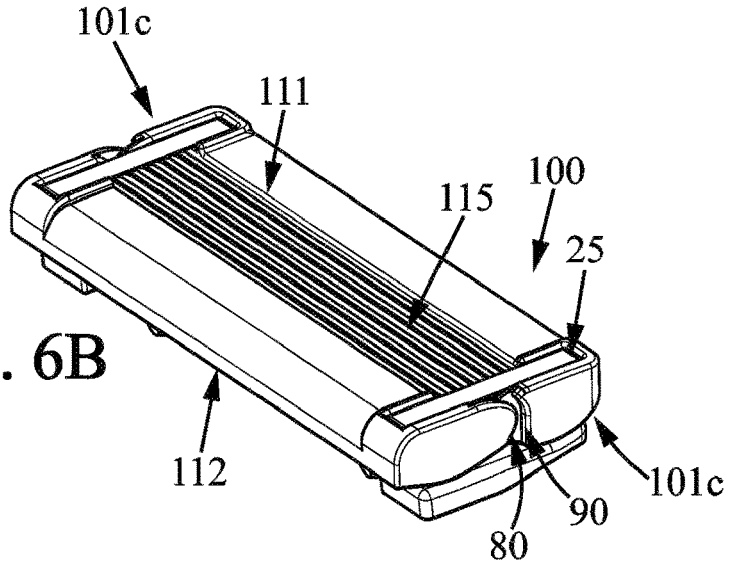
FIG. 6B is a perspective view of the shaving cartridge of FIG. 3 assuming a substantially planar configuration.
Figure 6C:
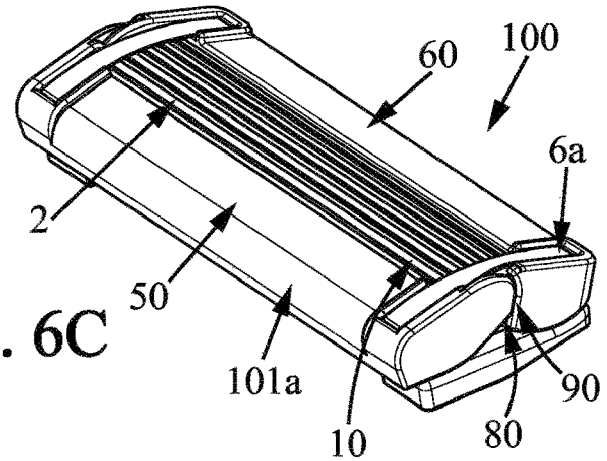
FIG. 6C is a perspective view of the shaving cartridge of FIG. 3 assuming a convex configuration.

According to some aspects, as detailed in FIGS. 6A-6C, a shaving cartridge 100 may include a housing 101 having a front portion 101*a* and a rear portion 101*b* opposing the front portion 101*a*. Each of the portions 101*a*, 101*b* may include a plurality of side portions 101*c*. Further, the housing 101 may include a top portion 111, and a bottom portion 112 opposite to the top portion 111. The top portion 111 and the bottom portion 112 may be parallel to each other. The plurality of side portions 101*c* may extend between the front portion 101*a* of the housing and the rear portion 101*b* of the housing. The side portions 101*c* may face each other. The plurality of side portions 101*c* may include a front abutment 80 and a rear abutment 90. The shaving cartridge 100 may include a guard bar 50 adjacent to the front portion 101*a* of the housing 101 and a cap 60 adjacent to the rear portion 101*b* of the housing 101. The housing 101 may have a shaving window 115 which may be a recess or cavity. The shaving window 115 may be configured to receive the shaving component 10. The shaving component 10 may be arranged between the front portion 101*a* of the housing and the rear portion 101*b* of the housing. When the guard bar 50 and the cap 60 may be provided, the shaving component 10 may be positioned between the guard bar 50 and the cap 60. The at least one cutting member 2 of the shaving component 10 may be arranged such that is the at least one cutting member 2 may be exposed via the top portion 111 of the housing 101. The top portion 111 of the housing may be a top surface of the housing 101. The housing 101 may be provided with a cavity 25 extending along the lateral axis Z-Z, from the top portion 111 of the housing to the bottom portion 112. The cavity 25 may have rectangular shape, a square shape or any other suitable shape. The cavity 25 may be shaped such that the leg 7 of the flexible strip 1 may be inserted into the cavity 25. As disclosed above, the leg 7 may include the projection 8 extending from said leg 7, away from the cutting member 2. The cavity 25 may be shaped such that the cavity 25 may be able to receive the leg 7 with the projection 8. The projection 8 may assist with securing the shaving component 10 within the housing 101. Legs 7 may inhibit movement of the shaving component 10 relative to the housing 101. Therefore, the risk of unintentionally removing the shaving component 10 from the shaving cartridge may be minimized. In other words, the shape of the leg 7 of the flexible strip1 may cooperate with the cavity 25 to secure the shaving component 10 within the housing 101. The shaving component 10 may be placed within the housing 101 such that the body 6 of the flexible strip 1 may be located on the top portion 111 of the housing 101.

Each one of the plurality of side portions 101*c* may include a connector 30 that may rotatably secure a front portion 101*a* and a rear portion 101*b* together so that each of the plurality of side portions 101*c* may be operable to pivot relative to each other, as illustrated in FIGS. 6A-6C. According to some aspects, "pivot" may be understood that the axis of rotation of the front portion 101*a* with respect to the rear portion 101*b* may be fixed, or may move if, in addition to the rotation, the side portions 101*c* may be guided in translation with respect to one another. Such connector 30 may be a hinge or a living hinge. The connector 30 may also have the shape of a rivet or a pin and a respective recess, allowing the front portion 101*a* to rotate relative to the rear portion 101*b*. Each of the connectors 30 may define an axis that may allow the guard bar 50 to rotate in either direction thereabout as the shaving cartridge 100 may travel along contours, e.g., convex and/or concave contours, of a shaving surface.

The flexible strip 1 of the shaving component 10 may be resilient, thereby (i) allowing each of the plurality of side portions 101*c* to pivot as illustrated by FIGS. 6A and 6C, (ii) defining maximum degrees of pivot of the plurality of side portions 101*c*, and (iii) biasing the plurality of side portions 101*c* to a parallel configuration whereby the top portion 111 of the housing 101 may have a substantially planar surface as illustrated by FIG. 6B. The maximum degrees of pivot of the plurality of side portions 101*c* may also be defined by the front abutment 80 and said rear abutment 90. As such, when the housing 101 may assume the convex configuration or the concave configuration, the front abutment 80 and the rear abutment 90 may come into contact. At this stage, the maximum degrees of pivot may be achieved and no further deflection of the housing 101 may be allowed.

According to further aspects, the shaving cartridge 100 may be operable to adapt to, change shape to follow the shaving surface, e.g., skin of the user, and may thereby provide a close shave to the user and an improved shaving experience relative to conventional shaving heads. The close shave that may be provided may allow the user to sever unwanted hair closer to the skin relative to conventional shaving heads and avoid unwanted nicks and cuts, especially in difficult-to-shave spots, e.g., around a chin of the user or behind a knee of the user, etc.

According to aspects, as shown in FIGS. 6A and 6B, the shaving cartridge 100 may be operable to interact with the skin of the user. More particularly, when the shaving cartridge 100 may come into contact with a recess of the skin, i.e., the concave skin area, the connectors 30 may be operable to pivot so that the guard bar 50 and the cap 60 may make contact or touch the skin first, which may cause the housing 101 to assume the convex configuration. While the housing 101 may assume the convex configuration, the flexible strip 1 may assume the convex configuration on the top face 6*a* of the body 6. The bottom face 6*b* of the body 6 may assume the concave configuration. According to some aspects, a concave skin area may include a skin area/shaving surface that may be curved inward. In this manner, nicks, cuts, or an "attack" on the skin may be avoided during use of the shaving cartridge 100 and the improved shaving may be achieved. Likewise, when the shaving cartridge 100 may come into contact with a protrusion of the skin, i.e., the convex skin area, the connectors 30 may be operable to pivot so that the housing 101 may assume the concave configuration (see FIG. 6A). In other words, the forces acting from the convex skin area during the shaving may be applied on the shaving cartridge 100 causing the shaving cartridge 100 to assume the concave configuration. As such, the flexible strip 1 of the shaving component 10 may assume, on the top face 6*a* of the body, the concave configuration, while the bottom face of the body may assume the convex shape. According to some aspects, a convex skin area may include a skin area/shaving surface that may bulge or curve outward. In this manner, a smoother cutting-edge contact, thereby providing a close shave without any additional effort from the user may be provided. When the shaving cartridge 100 may come into contact with the flat/planar skin, the forces acting from the flat skin may cause the shaving cartridge 100 to assume the planar configuration. According to aspects, a flat/planar skin may include the skin area/shaving surface where no protrusions/recess.

It will be appreciated by those skilled in the art that changes could be made to the examples described above without departing from the broad disclosure thereof. It is understood, therefore, that the present disclosure disclosed herein is not limited to the particular examples disclosed and is intended to cover modifications within the spirit and scope of the present disclosure.

One of skill in the art will recognize that the detailed aspects may not be limited to any particular size. Further, one of skill in the art will recognize that the components of the shaving cartridge 10 may not be limited to any type of material. According to an aspect, the housing may be formed of a polymer, but may be formed of a variety of different materials including one or more metal materials or the like, or a combination thereof. One skilled in the art will recognize that different diameters, types, and thicknesses of materials may also be utilized when taking into consideration design and stability considerations. A number of manufacturing techniques may be used such as the machining, molding, or casting one or more components of the retainer. An example process of manufacturing the housing 101 may include the use of an injection-molding machine or other like manufacturing means.

It will be appreciated by those skilled in the art that changes could be made to the aspects detailed above without departing from the broad disclosure thereof. It is understood, therefore, that the present disclosure herein is not limited to the particular aspects disclosed and is intended to cover modifications within the spirit and scope of the disclosure.

III. Method of Manufacturing a Shaving Component

According to further aspects, a method of manufacturing the shaving component may include at least a step of providing at least one cutting member 2 having a cutting-edge 5 extending along a longitudinal axis X-X, a step of providing a flexible strip 1 extending along a transverse axis Y-Y, and a step of assembling said at least one cutting member 2 onto the flexible strip 1, wherein the flexible strip 1 may be configured to assume different configurations while retaining the at least one cutting member 2 in a secured position with respect to the flexible strip 1.

According to some aspects, method of manufacturing the shaving component further include one or more of the following features:

providing the at least one flexible strip 1 having a body 6 and at least one leg 7, the body 6 having a top face 6*a* and a bottom face 6*b*, wherein the top face 6*a* may be configured to assume the plurality of configurations;

the at least one leg 7 of the flexible strip may include a projection 8 protruding from the said leg 7 along the transverse axis Y-Y away from the cutting member 2;

providing the shaving component 10 with at least one strip portion 4 extending from the body 6 of the flexible strip 1 and being made out of the same material as the body 6, and assembling the at least one cutting member onto the strip portion 4;

the shaving component 10 may include a plurality of cutting members 2 being parallel to each other and being assembled onto the flexible strip 1.

The invention claimed is:

1. A shaving component for receipt in a shaving cartridge, the shaving component comprising:

at least one cutting member including a cutting edge, and extending along a longitudinal axis and at least one flexible strip;

the at least one flexible strip being connected to the at least one cutting member and extending along a transverse axis, the transverse axis being transverse to the longitudinal axis; and the at least one flexible strip being configured to assume a plurality of configurations while retaining the at least one cutting member in a secured position with respect to the flexible strip, wherein the at least one flexible strip includes a body and at least one leg extending from the body, the body includes a top face and a bottom face opposite to the top face, the bottom face of the body is adjacent to the cutting edge of the cutting member, and the at least one leg extends along a lateral axis, transverse to both the longitudinal axis and the transverse axis, and the at least one leg extends from the bottom face of the body.

2. The shaving component according to claim 1, wherein the at least one leg of the flexible strip includes a projection, the projection protrudes from the at least one leg, along the transversal axis in a direction away from the cutting member.

3. The shaving component according to claim 1, wherein the body includes a first end and a second end, the at least one leg includes a first leg and a second leg, the first leg extends from the first end of the body, and the second leg extends from the second end of the body and is parallel to the first leg, and the cutting member extends between the first leg and the second leg.

4. The shaving component according to claim 3, wherein the second leg of the flexible strip includes a projection protruding from the second leg, along the transversal axis in a direction away from the cutting member.

5. The shaving component according to claim 1, wherein the top face of the body is configured to assume the plurality of configurations, and wherein the plurality of configurations includes (i) a convex configuration, (ii) a concave configuration, or (iii) a planar configuration.

6. The shaving component according to claim 1, wherein the at least one flexible strip includes a body, the body includes at least one strip portion extending from the body along the transverse direction, the body and the at least one strip portion being made out of the same material, and the cutting member being connected by weld onto the at least one strip portion.

7. The shaving component according to claim 6, wherein the at least one strip is a first strip and a second strip, the cutting member being connected at one of the two lateral sides, respectively, to the first strip and the second strip.

8. The shaving component according to claim 7, wherein the at least one strip portion extends along the longitudinal axis from the first strip to the second strip.

9. The shaving component according to claim 1, wherein the at least one cutting member includes a central portion and two lateral sides, at least one of the lateral sides includes a connecting mechanism, and the flexible strip is connected to the connecting mechanism.

10. The shaving component according to claim 1, wherein the at least one cutting member includes a plurality of cutting members, the plurality of cutting members all being parallel to each other and being connected to the at least one flexible strip.

11. A shaving cartridge comprising:

a shaving component according to claim 1, and a housing including a top portion provided with a shaving window, the housing is configured to receive the shaving component such that the cutting member is exposed through the shaving window of the top portion of the housing.

12. The shaving cartridge according to claim 11, wherein the housing is provided with a cavity extending from the top portion of the housing, and wherein the cavity receives the at least one leg of the flexible strip.

13. A method of manufacturing a shaving component comprising:

providing at least one cutting member having a cutting edge extending along a longitudinal axis;

providing a flexible strip extending along a transverse axis, the transverse axis being transverse to the longitudinal axis, the flexible strip having a body and at least one leg, the body having a top face and a bottom face, and the top face is configured to assume a plurality of configurations;

connecting the at least one cutting member to the flexible strip such that the top face of the flexible strip is capable of being maneuvered to assume the plurality of configurations while retaining the at least one cutting member in a secured position with respect to the flexible strip.

14. The method of manufacturing the shaving component according to claim 13, wherein the step of providing the at least one leg includes:

providing the at least one leg with a projection protruding from the at least one leg along the transverse axis away from the cutting member;

providing the shaving component with at least one strip portion extending from a body of the strip, the at least one strip being made out of the same material as the body; and assembling the at least one cutting member onto the at least one strip portion.

15. The method of manufacturing the shaving component according to claim 13, wherein the step of providing the at least one cutting member includes:

providing a plurality of cutting members; and assembling the plurality of cutting members parallel to each other onto the flexible strip.

* * * * *